US011272772B2

(12) United States Patent
Kuzia

(10) Patent No.: US 11,272,772 B2
(45) **Date of Patent: *Mar. 15, 2022**

(54) HEATED HAIR SETTER APPARATUS AND METHOD

(71) Applicant: Spectrum Brands, Inc., Middleton, WI (US)

(72) Inventor: Jay William Kuzia, Madison, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 188 days.

This patent is subject to a terminal disclaimer.

(21) Appl. No.: 16/696,413

(22) Filed: Nov. 26, 2019

(65) Prior Publication Data

US 2020/0093239 A1 Mar. 26, 2020

Related U.S. Application Data

(62) Division of application No. 16/096,584, filed as application No. PCT/US2017/032621 on May 15, 2017, now Pat. No. 10,524,553.

(Continued)

(51) Int. Cl.

| | |
|---|---|
| ***A45D 2/36*** | (2006.01) |
| ***A45D 4/16*** | (2006.01) |
| ***A45D 2/12*** | (2006.01) |
| ***A45D 2/14*** | (2006.01) |
| ***A45D 4/12*** | (2006.01) |

(52) U.S. Cl.

CPC ..... *A45D 4/16* (2013.01); *A45D 2/12* (2013.01); *A45D 2/122* (2013.01); *A45D 2/125* (2013.01); *A45D 2/146* (2013.01); *A45D 2/362* (2013.01); *A45D 4/12* (2013.01)

(58) Field of Classification Search

CPC ... A45D 2/00; A45D 2/02; A45D 2/04; A45D 2/06; A45D 2/08; A45D 2/10; A45D 2/122; A45D 2/125; A45D 2/145; A45D 2/36; A45D 2/362; A45D 2/367; A45D 4/06;

(Continued)

(56) References Cited

U.S. PATENT DOCUMENTS

| | | | |
|---|---|---|---|
| 2,824,367 | A | 2/1958 | Mcwilliams |
| 3,089,236 | A | 5/1963 | Galvao |

(Continued)

FOREIGN PATENT DOCUMENTS

| | | | |
|---|---|---|---|
| EP | 0611043 | A1 | 8/1994 |
| EP | 1884331 | A1 | 2/2008 |
| GB | 2036629 | A | 7/1980 |

*Primary Examiner* — Rachel R Steitz

(74) *Attorney, Agent, or Firm* — Armstrong Teasdale LLP

(57) ABSTRACT

A hair setter apparatus generally includes a housing and a heater assembly having a first heat delivery rail and a second heat delivery rail mounted in the housing in spaced parallel relationship to each other. The apparatus further includes a plurality of hair setters. Each of the hair setters has a central body with opposing web plates spaced from each other to define a mounting slot extending longitudinally of the hair setter and configured to slidably couple the hair setter to one of the heat delivery rails along a longitudinal edge of one of the heat delivery rails. The hair setter is sized relative to the insert opening for insertion of the hair setter through an insert opening and onto the respective one of the heat delivery rails within the interior space of the housing.

20 Claims, 9 Drawing Sheets

Related U.S. Application Data

(60) Provisional application No. 62/336,992, filed on May 16, 2016.

(58) Field of Classification Search
CPC . A45D 4/085; A45D 4/10; A45D 4/12; A45D 4/16; A45D 2006/005; A45D 6/14
USPC ..... D28/38
See application file for complete search history.

(56) References Cited

U.S. PATENT DOCUMENTS

| | | | | |
|---|---|---|---|---|
| 3,116,551 | A | 1/1964 | Anton | |
| 3,119,180 | A | 1/1964 | Bruecker | |
| 3,261,091 | A | 7/1966 | van den Driest | |
| 3,710,442 | A | 1/1973 | Meyer | |
| 5,301,425 | A | 4/1994 | Ferraro | |
| 5,408,749 | A | 4/1995 | Momose | |
| 6,084,210 | A * | 7/2000 | Glucksman | A45D 4/16 132/229 |
| 6,114,661 | A | 9/2000 | Leung | |
| 6,499,195 | B1 | 12/2002 | Wong | |
| 7,178,242 | B2 | 2/2007 | Okabe | |
| 7,665,214 | B2 | 2/2010 | Okabe | |
| 8,327,860 | B2 * | 12/2012 | Flowers | A45D 2/42 132/233 |
| 2005/0056297 | A1 | 3/2005 | Maione | |
| 2010/0116286 | A1 * | 5/2010 | O'Rourke | A45D 4/16 132/254 |

* cited by examiner

HEATED HAIR SETTER APPARATUS AND METHOD

CROSS-REFERENCE TO RELATED APPLICATIONS

This application is a divisional of U.S. patent application Ser. No. 16/096,584, filed on Oct. 25, 2018, which claims priority to International Application PCT/US2017/032621, filed on May 15, 2017, which claims priority to U.S. Provisional Application No. 62/336,992, filed on May 16, 2016. These applications are incorporated herein in their entirety.

FIELD OF THE DISCLOSURE

The present disclosure relates generally to a hair styling apparatus, and more particularly to a heated hair setter system having an array of vertically aligned hair setter assemblies.

BACKGROUND OF THE DISCLOSURE

Many different types of heated hair setter systems are available for use in styling hair, such as by curling, waving, or otherwise achieving a desired look. Common among such hair styling apparatus is the ability to apply heat to a hair setter and/or a hair retention clip associated with the hair setter. The hair setter and/or a hair retention clip provide one or more heated surfaces against which the hair to be styled is contacted during styling.

During use, at least some heated hair setter systems provide heat to the hair setter and the hair retention clip separately. These systems, however, may be large and require excess space for use and/or storage due to separately heating the hair setters and the hair retention clips, or to reduce the size of the system, the number of hair setters and the hair retention clips may be reduced. Other heated hair setter systems provide heat to the hair setters and the hair retention clips in combination. In particular, some heated hair setter systems heat the hair setter with the hair retention clip mounted to the hair setter. However, with these heated hair setter systems, a user can mount the hair retention clip to the hair setter such that the hair retention clip can directly contact the heating device. Thus, the hair retention clip can melt and/or otherwise become damaged by the heating device. There is a need, therefore, for a compact heated hair setter system that can rapidly heat a hair setter and hair retention clip assembly while preventing damage to the hair retention clip.

BRIEF DESCRIPTION

In one aspect, a hair setter apparatus generally comprises a housing comprising a base and a lid pivotally coupled to the base. The base generally comprises a top wall and a plurality of side walls together with the base and top wall defining an interior space of the housing. The base further comprises a plurality of access openings open to the interior space of the housing, with each access opening comprising an insert opening at the top wall and a vertical slot in at least one of the side walls and intersecting the insert opening at the top wall of the housing. A heater assembly is enclosed within the housing, with the heater assembly comprising a first heat delivery rail and a second heat delivery rail mounted in the housing in spaced parallel relationship to each other. Each heat delivery rail has a longitudinal edge extending parallel and generally adjacent to a respective one of the vertical slots and generally below a corresponding insert opening. The apparatus further comprises a plurality of hair setters, with each of the hair setters comprising a central body having opposing web plates spaced from each other to define a mounting slot extending longitudinally of the hair setter. The opposing web plates are configured to slidably couple the hair setter to one of the heat delivery rails along the longitudinal edge of one of the heat delivery rails. The hair setter is sized relative to the insert opening for insertion of the hair setter through the insert opening and onto the respective one of the heat delivery rails within the interior space of the housing.

In yet another aspect, a method of operating a hair setter apparatus generally comprises coupling a retention clip to a hair setter. The hair setter comprising a central body having opposing web plates spaced from each other to define a mounting slot extending longitudinally of the hair setter. The method further comprises inserting the hair setter through an access opening of a housing. The housing comprising a base and a lid, with the base comprising a top wall and a plurality of side walls together with the base and top wall defining an interior space of the housing. The base further comprising a plurality of the access openings open to the interior space of the housing, each access opening comprising an insert opening at the top wall and a vertical slot in at least one of the side walls and intersecting the insert opening at the top wall of the housing. The hair setter is sized relative to the insert opening for insertion of the hair setter through the insert opening and onto the heat delivery rail within the interior space of the housing. The method also comprises slidably coupling the hair setter onto a heat delivery rail mounted in the housing. The heat delivery rail has a longitudinal edge extending parallel and generally adjacent to the vertical slot and generally below the insert opening.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings. The singular forms "a," "an," and "the" include plural references unless the context clearly dictates otherwise. The terms "comprising," "including," and "having" are intended to be inclusive and mean that there may be additional elements other than the listed elements. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

Figure 1:
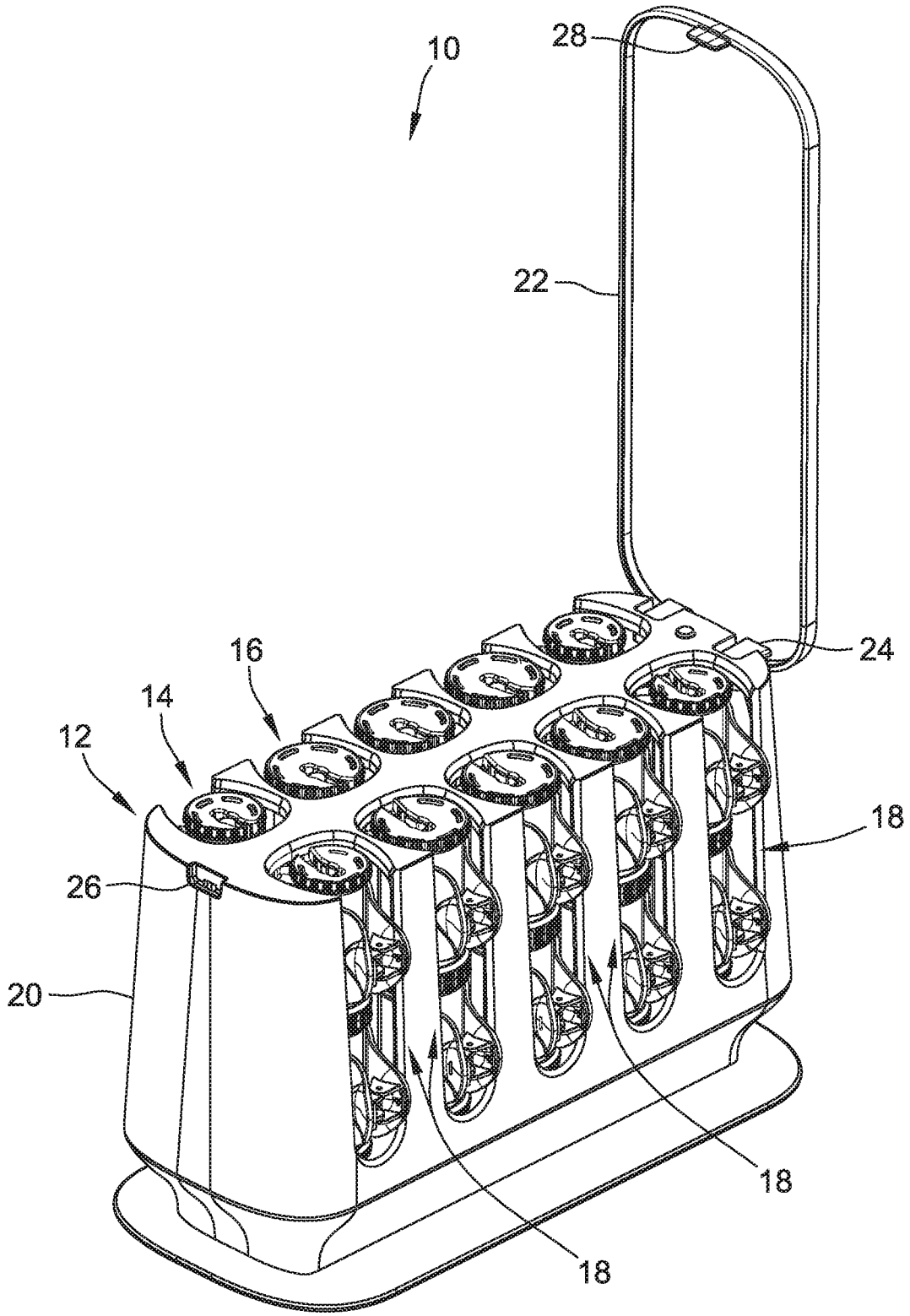
FIG. 1 is an isometric schematic of a heated hair setter system shown in an opened configuration and containing a plurality of hair setter assemblies.
Figure 2:
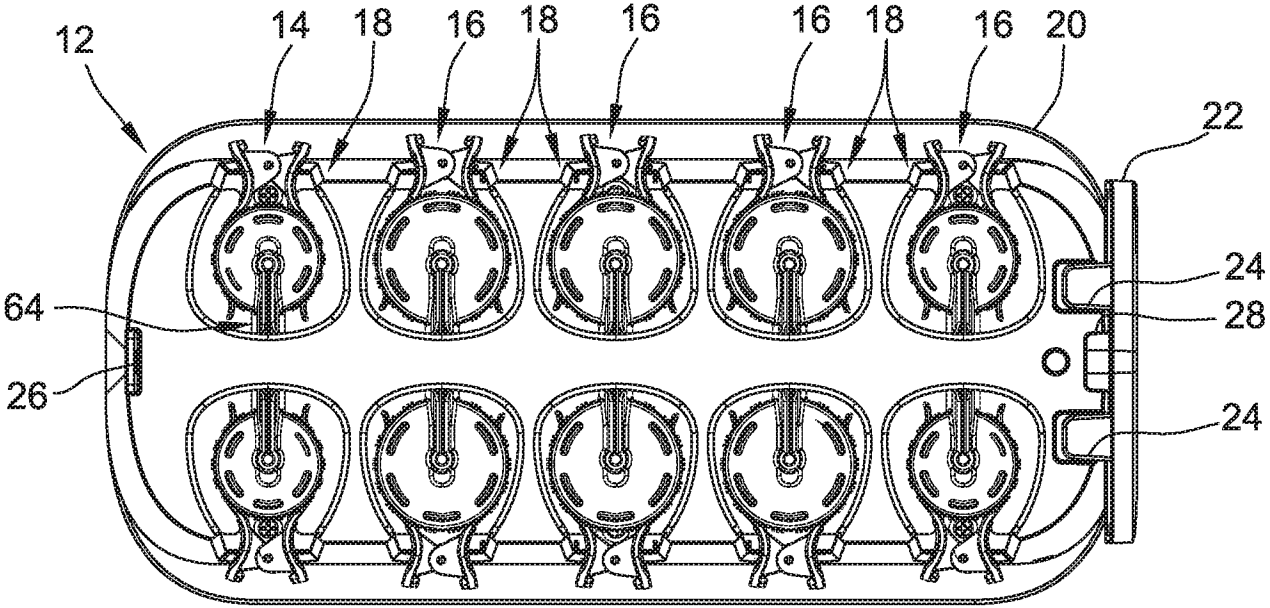
FIG. 2 is a top view of the heated hair setter system shown in FIG. 1.

Referring now to the drawings and in particular to FIGS. 1 and 2, FIG. 1 is an isometric schematic of a heated hair setter system 10 shown in an opened configuration and containing a plurality of hair setter assemblies. FIG. 2 is a top view of the heated hair setter system 10 shown in FIG. 1. In the exemplary embodiment, the heated hair setter system 10—also referred to as a hair setter—includes a generally cuboid-shaped, elongate housing assembly 12 holding a plurality of hair setter assemblies, for example, small hair setter assembly 14 and large hair setter assembly 16. It is noted that a hair setter may also be known as a hair curler or a hair roller. In the illustrated embodiment, the hair setter assemblies 14 and 16 are stacked vertically in respective pairs and are contained in access openings 18 formed in the housing assembly 12. As shown in FIG. 2, the stacked pairs of hair setter assemblies 14 and 16 are generally arranged in a side-to-side relationship with each other, forming a rectangular array. Alternatively, the hair setter assemblies 14 and 16 may be arranged in any configuration that enables the heated hair setter system 10 to function as described herein. For example, in some embodiments, the hair setter assemblies 14 and 16 may not be stacked, or may include more than two assemblies in stacked, vertical alignment. In addition, the hair setter assemblies 14 and 16 may be arranged other than in a generally rectangular array. For example, in some embodiments, the housing assembly 12 could be generally circular-shaped with the access openings 18 formed about a perimeter of the housing assembly 12, or arranged in other shapes that results in a different stacking array or pattern.

In the exemplary embodiment, the housing assembly 12 includes a base 20 and a lid 22 positionable in a closed configuration to facilitate holding the hair setter assemblies 14 and 16 within the housing 12, and an open configuration to facilitate access to and removal of the hair setter assemblies 14 and 16 from the housing 12. As illustrated in FIGS. 1 and 2, in the exemplary embodiment, the lid 22 is rotatably coupled to the base 20 by two hinge arms 24 coupled to respective hinge pins (not shown). Although depicted as hinge arms 24 coupled to hinge pins, lid 22 can be rotatably coupled to base 20 using any type of hinge that enables housing 12 to function as describe herein, e.g., using a continuous hinge, a living hinge, or the like. Alternatively, the lid 22 can be positionable on housing 12 in any manner that enables the lid 22 to function as described herein. For example, in some embodiments, the lid 22 may be completely removable from housing 12 in the open configuration, and may snap or otherwise securely fasten (e.g., via a resistance member secured around the lid and housing in the closed configuration) to housing 12 in the closed configuration. In other embodiments, the lid 22 may be configured to slide on housing 12 between the open and closed configurations.

As shown in FIGS. 1 and 2, in the exemplary embodiment, the housing 12 includes a latch system to facilitate keeping the lid 22 in the closed configuration. For example, in the exemplary embodiment, the base 20 includes a catch 26 for receiving a corresponding latch member 28 formed on the lid 22. In particular, the latch 28 is formed on the underside of the lid 22 and depends therefrom for latching engagement with the catch 26 formed on an end of the base 20 when the lid 22 is closed to releasably secure the lid 22 in its closed configuration. Alternatively, the latch 28 may be attached to the base 20 and the catch 26 formed on the lid 22 without departing from the scope of this disclosure. It is contemplated that, in some embodiments, the housing 12 does not include a latch system, as described herein. In such embodiments, the lid 22 may be held in place, for example, via friction coupling, through the use of resistance members, and the like. In some embodiments, the lid 22 may not be securely held in place, but may rest on housing 12 in the closed configuration.

Figure 3:
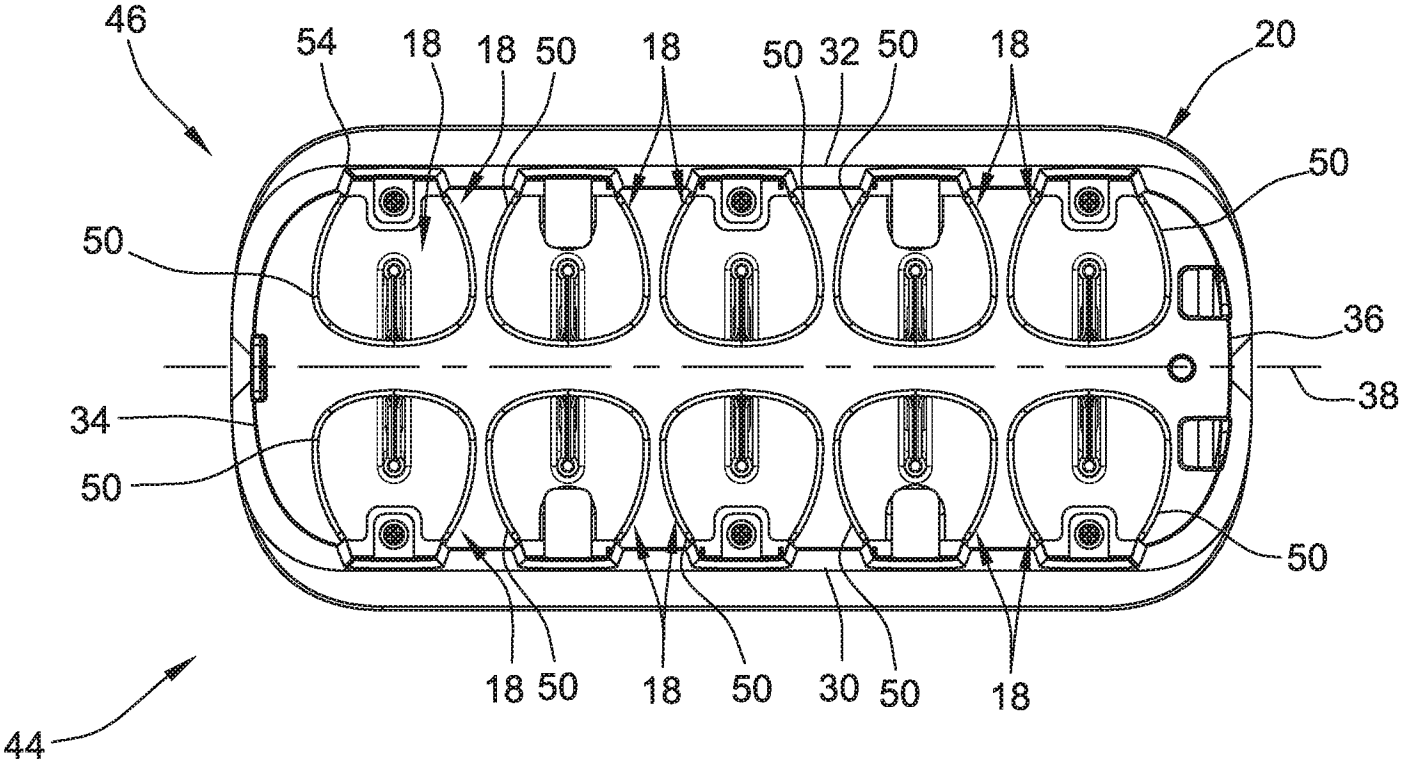
FIG. 3 is a top view of a base of the housing of the heated hair setter system shown in FIG. 1, having the hair setter assemblies removed for clarity.
Figure 4:
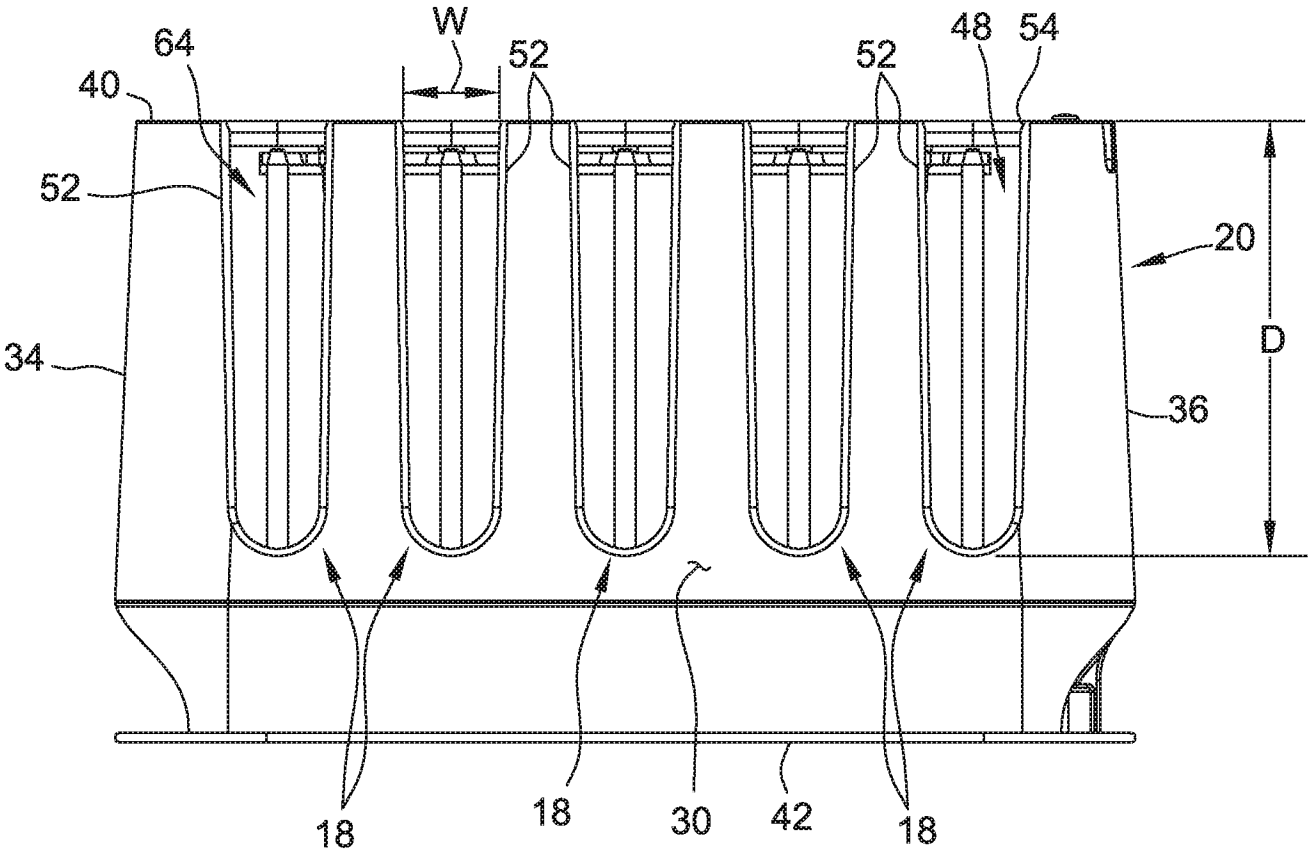
FIG. 4 is a front view of the base.

FIG. 3 is a top view of the base 20 of the housing 12 of the heated hair setter system 10 shown in FIG. 1, having the hair setter assemblies 14 and 16 removed for clarity. FIG. 4 is a front view of the base 20. The exemplary base 20 is a molded container that is generally cuboid in shape. Accordingly, the features of the base 20 described herein may have a draft angle associated with each wall and cavity to promote removal of the base 20 from a mold. The base 20 is fabricated by injection molding a thermoplastic synthetic resin suitable for use in heated hair setter system 10. However, the base 20 may be fabricated from any non-conductive material that enables the base 20 to function as described herein. Furthermore, the base 20 may be fabricated by methods other than molding, e.g., machining, and therefore may not have a draft angle associated with the features as described herein.

The base 20 is a hollow generally cuboid-shaped structure that broadly includes a front wall 30, a rear wall 32, a left end wall 34, and an opposing right end wall 36. In the exemplary embodiment, the base 20 is generally symmetrical about a central longitudinal axis 38 running substantially parallel to the front wall 30 and the rear wall 32. The base 20 also includes a top wall 40 and a bottom wall 42. An interior space 48 is defined by the defined by the walls 30, 32, 34, 36, 40, and 42. As described above, a plurality of access openings 18 are formed in the base 20. Each access opening 18 is open at the top wall 40 and extends downward toward the bottom wall 42 of the base 20. In the exemplary embodiment, the base 20 includes five access openings 18 arranged in a side by side configuration extending along a front half 44 of the base 20, and, with respect to central longitudinal axis 38, five access openings 18 extending along a back half 46 of the base 20. Alternatively, the base 20 may include any number of access openings 18 that enable the base 20 to function as described herein.

In the exemplary embodiment, each one of the access openings 18 include a generally curved shaped insert opening 50 that extends through the top wall 40 to the interior space 48. In addition, the access openings 18 include rectangular-shaped vertical slots 52 formed through one of the front wall 30 or the rear wall 32, depending on whether the respective access opening 18 is formed along the front half 44 or the back half 46 of the base 20. The vertical slots 52 are provided in positions that are symmetric to each other in relation to the central longitudinal axis 38. The vertical slots 52 are open at the top wall 40 of the base 20, connecting to a respective insert opening 50, and extend downward a predetermined distance "D" of the height of the respective front wall 30 or the rear wall 32. For example, in some embodiments, the distance "D" is configured such that the distance is less than a height of a heater assembly contained in the housing assembly 12. This enables a portion of the front wall 30 or the rear wall 32 to extend across a bottom portion of the heater assembly and cover a bottom portion thereof.

As shown in FIG. 4, each of the vertical slots 52 extend widthwise a predetermined distance "W," as generally indicated at the top wall 40. Alternatively, the vertical slots 52 may be of varying widths and heights that enable the base 20 to function as described herein. In the exemplary embodiment, with reference to FIG. 3, it can be seen that the width "W" is narrower than the insert opening 50. The insert openings 50 and vertical slots 52 facilitate the insertion and removal of the hair setter assemblies 14 and 16 and limiting the amount of rotational movement of the hair setter assemblies 14 and 16. In addition, the narrow width "W" of the vertical slots 52 facilitate protecting a user's fingers from entering the insert opening 18 through the vertical slot 52 and contacting the heater assembly contained therein.

In the exemplary embodiment, the insert openings 50 and vertical slots 52 are shaped to facilitate insertion of the hair setter assemblies 14 and 16 into the base 20. Referring to FIGS. 3 and 4, edges of the insert openings 50 and vertical slots 52 taper outward, away from the access opening 18, to create generally tapered edges 54 or chamfers. In the exemplary embodiment, tapered edges 54 are configured such that edges of the insert openings 50 and vertical slots 52 are generally smooth and free of sharp breaks, and to facilitate insertion of the hair setter assemblies 14 and 16. Alternatively, the tapered edges 54 may be defined in any configuration that permits the base 20 to function as described herein.

Figure 5:
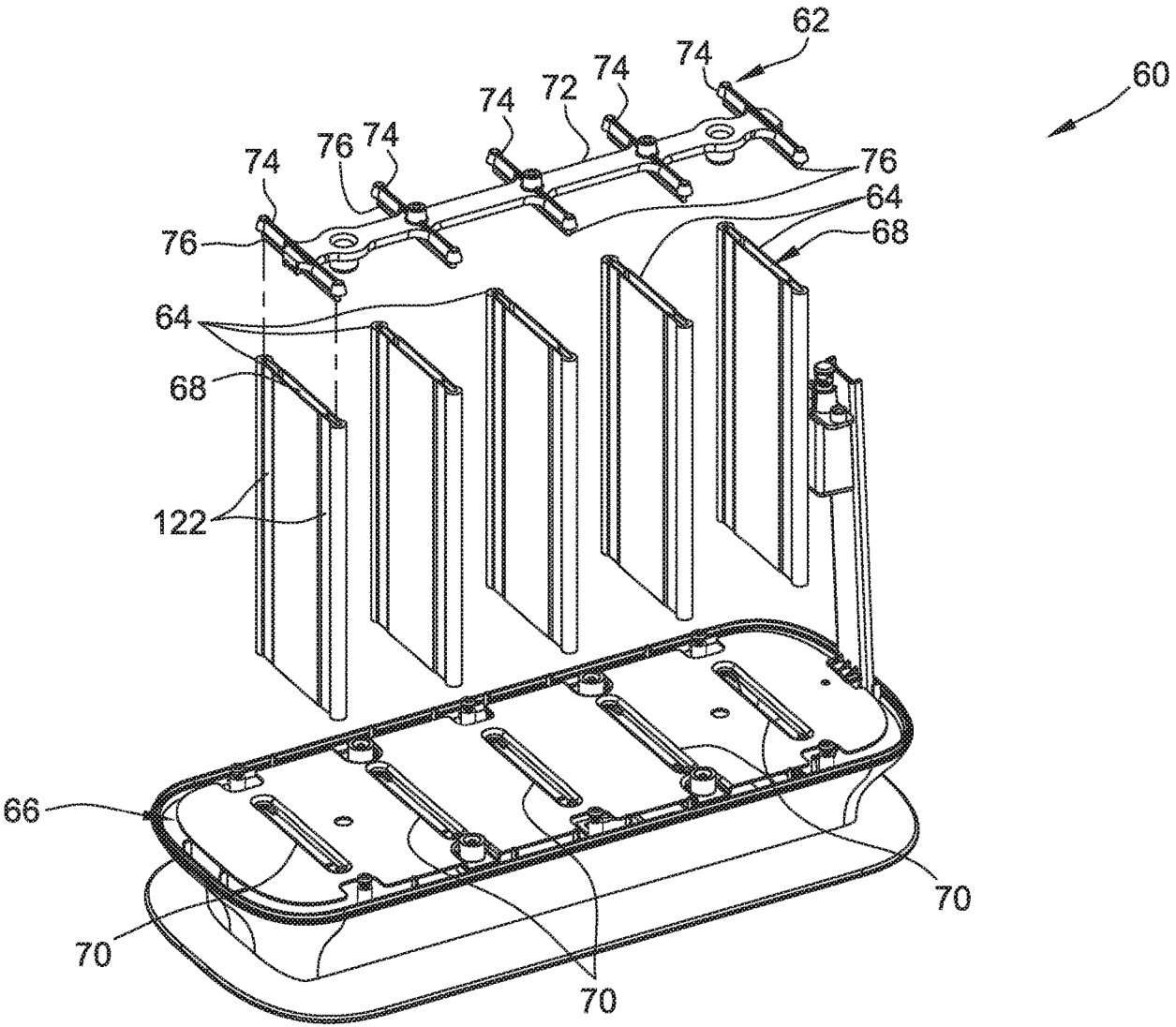
FIG. 5 is an exploded isometric schematic view of a heater assembly of the heated hair setter system shown in FIG. 1.

As illustrated in FIGS. 3 and 4, the base 20 encloses other components of the heated hair setter system 10, for example, a heater assembly 60. FIG. 5 is an exploded isometric schematic view of the heater assembly 60 of the heated hair setter system 10 shown in FIG. 1. The heater assembly 60 includes a brace 62, a plurality of vertically-standing heat delivery rails 64, and a support plate 66. As illustrated, the plurality of vertically-standing heat delivery rails 64 are parallel and longitudinally-spaced to enable the hair setter assemblies 14 and 16 to be vertically stacked in the housing 12 as shown in FIG. 1.

In the exemplary embodiment, each one of the heat delivery rails 64 is formed substantially identically. As illustrated in FIG. 5, the heat delivery rails 64 are fabricated from a generally symmetrical, elongated panel extending substantially vertically. For example, in the exemplary embodiment, the heat delivery rails 64 are substantially symmetrical from front to back, from side to side, and from end to end. Such a heat delivery rail configuration facilitates efficient heating of the hair setter assemblies 14 and 16 using a decreased size heat delivery rail 64. The symmetrical design enables a plurality of the hair setter assemblies 14 and 16 to be heated on each side of the heat delivery rail 64. As illustrated in FIG. 5, and discussed in more detail below, the heat delivery rails 64 have an elongate, generally rectangular cross section with curved ends 120. Proximate the curved ends 120 are opposing grooves 122 on each side of the heat delivery rail 64. More specifically, the grooves 122 intersect a respective curved end 120. The grooves 122 extend axially the length of the heat delivery panel 64 transversely to the cross section of the panel.

In the exemplary embodiment, the heat delivery rails 64 include a hollow center portion 68 for enclosing a heating element (not shown) used for increasing the temperature of the heat delivery rails 64 during use of the heated hair setter system 10. The heating element is thermally coupled to the heat delivery rails 64 via the hollow center portion 68. In one embodiment, for example, the heating element is electrically coupled to a control system (not shown) via suitable wiring (not shown). The heating element may include, for example, electrical resistance heaters, coupled in thermal contact with the heat delivery rails 64 to heat the heat plate during use of the heated hair setter system 10.

In the exemplary embodiment, the heat delivery rails 64 may be fabricated from a metallic material to facilitate increased heat transfer between the heating element (not shown) and the heat delivery rails 64. Alternatively, the heat delivery rails 64 may be fabricated from any material that enables the heat delivery rails 64 to function as described herein. In addition, in the exemplary embodiment, the heat delivery rails 64 may be formed as a single piece extruded component. This facilitates manufacturing efficiencies by reducing the number of components used to fabricate the heat delivery rails 64. Alternatively, the heat delivery rails 64 may be fabricated in any manner that enables the heat delivery rails 64 to function as described herein, e.g., by welding and/or otherwise bonding two heat transfer components together to form the heat delivery rails 64.

In the exemplary embodiment, the support plate 66 includes a plurality of rail seats 70, formed as elongate channels in support plate 66. The rail seats 70 are shaped to generally correspond to a cross-sectional shape of the heat delivery rails 64, thereby facilitating securely holding each heat delivery rail 64 in place when the heater assembly 60 is assembled. While the rail seats 70 are illustrated as being generally equispaced along a length of the support plate 66, it is contemplated that any spacing that enables the heater assembly 60 to function as described herein may be used. In the exemplary embodiment, the support plate is fabricated from a metallic sheet material capable of supporting the heat delivery rails 64 during operation. Alternatively, the support plate 66 may be fabricated from any material that can support the heat delivery rails 64 during operation, including, e.g., plastic, ceramic, and the like.

The brace 62 of the heater assembly 60 is generally configured to couple to an end of each heat delivery rail 64 when the heat delivery rails 64 are mounted to support plate 66. As illustrated, the brace 62 includes a central spine 72 having a plurality of equispaced, transverse rail supports 74. As illustrated in FIG. 5, each rail support 74 is shaped to correspond to a cross-sectional shape of the heat delivery rails 64. This facilitates enabling a smooth transition from the rail support 74 to the respective heat delivery rail 64. In addition, each rail support 74 includes a lip 76 extending from an underside of the rail support 74. The lip 76 is sized to snuggly fit into the hollow center portion 68 of the heat delivery rail 64. This enables the brace 62 to securely hold each heat delivery rail 64 in place when the heater assembly 60 is assembled. The rail supports 74 are spaced such that each rail support 74 corresponds substantially with a rail seat 70 of the support plate 66. This facilitates positioning the heat delivery rails 64 in a parallel, equispaced relationship. In the exemplary embodiment, each rail support 74 is tapered inward as it extends away from the lip 76 to enable easy alignment and positioning of the hair setter assembly 14 and 16 on the heat delivery rail 64.

In the exemplary embodiment, the brace 62 is a molded component. Accordingly, the features of the brace 62 described herein may have a draft angle associated with each wall and cavity to promote removal of the brace 62 from a mold. The brace 62 is fabricated by molding a thermoplastic synthetic resin suitable for use as an insulator in heated devices. However, the brace 62 may be fabricated from any material that enables the brace 62 to function as described herein. Furthermore, the brace 62 may be fabricated by methods other than molding, e.g., machining, and therefore may not have a draft angle associated with the features as described herein.

Figure 6:
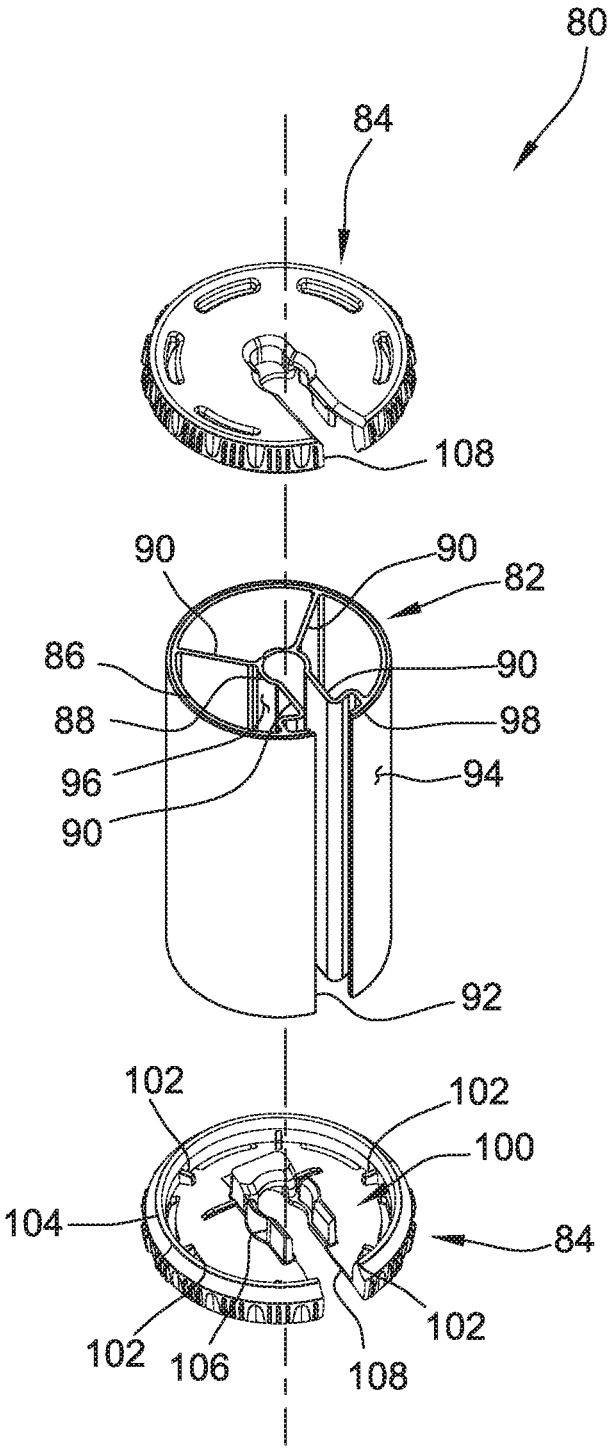
FIG. 6 is an exploded isometric schematic of a hair setter of the hair setter assemblies shown in FIG. 1.

FIG. 6 is an exploded isometric schematic of a hair setter 80 of the hair setter assemblies 14 and 16 shown in FIG. 1. In the exemplary embodiment, the hair setter 80 is substantially cylindrical in shape and includes a body 82 and an end cap 84 located at each end of the body 82. The body 82 includes a cylindrically-shaped outer tube 86 and a coaxially aligned cylindrically-shaped inner tube 88, which extends the entire length of the body 82. As illustrated in FIG. 6, the inner tube 88 and the outer tube 86 are free from direct contact along the length of the tubes. Rather, a plurality of radially extending web plates 90 are formed within the body 82 and extend between the inner tube 88 and the outer tube 86. The web plates 90 are in direct contact with the inner tube 88 and the outer tube 86. In addition, each of the web plates 90 has a length that is substantially equal to the length of the inner tube 88 and the outer tube 86.

In the exemplary embodiment, the body 82 includes a slot 92 defined therein. The slot 92 extends longitudinally along the overall axial length of the body 82 and extends inward from an outer surface 94 of the outer tube 86 through an outer surface 96 of the inner tube 88. The slot 92 is defined by a pair of opposing radially extending web plates 90. The slot 92 forms a passageway in the body 82 that has an overall width that is slightly greater than the width of the heat delivery rail 64 between the grooves 122 and smaller than an inner diameter of the inner tube 88. This enables the body 82 to be slidably coupled to the heat delivery rail 64. In particular, the combination of the narrower width of the slot 92 and the larger diameter of the inner tube 88 is configured to only engage the curved end 120 and opposing grooves 122 on a side of the heat delivery rail 64 in an axial direction. Thus, the body 82 can be slidably coupled to the heat delivery rail 64, being oriented in the axial direction of the rail and slidably moveable along the axial direction thereof. The body 82 is otherwise inhibited from being coupled to and decoupled from the rail in a direction transverse to the rail—which is the manner of coupling common among known hair setter systems.

Furthermore, the slot 92 is configured to enable the inner tube 88 and the slot defining web plates 90 to directly engage one of the heat delivery rails 64 of the heater assembly 60. By providing direct engagement or contact between the inner tube 88 and the slot defining web plates 90 and the heat delivery rail 64, heat transfer between the heat delivery rail 64 and hair setter 80 is enabled. Thus, heat transfer from the heater assembly 60 to hair setter 80 is achieved, with the hair setter 80 being constructed to enable the heat generated by the heat delivery rails 64 of the heater assembly 60 to be absorbed by the inner tube 88 and the slot defining web plates 90, and delivered rapidly and directly to the radially extending web plates 90. The heat absorbed by the web plates 90 is rapidly transferred to the outer tube 86, thereby assuring rapid heating of hair setter 80 in its entirety.

In the exemplary embodiment, the body 82 is fabricated from a metallic material, e.g., from aluminum, to enable efficient heat transfer from the heat delivery rails 64 of the heater assembly 60 to the body 82. In addition, the body is fabricated by conventional extrusion equipment, facilitating the manufacturing of the body 82 in a generally inexpensive and rapidly-produced manner. Alternatively, the body 82 may be fabricated in any manufacturing operation that enables the body 82 to function as described herein, for example, by casting.

In addition, the hair setter 80 includes an end cap 84 located at each end of the body 82. The end cap 84 includes a recess 100, which is sized and located so as to receive an end portion of the body 82. The end cap 84 also includes a plurality of ribs 102 extending radially inward from an outer edge 104 of the end cap a predetermined distance to facilitate engaging the outer surface 94 of the body 82 to locate the end cap 84 with respect to the outer tube 86 of the body 82. In addition, the end cap 84 includes an inner coupling component 106 configured to engage the inner tube 88 of the body 82 to facilitate locating the end cap 84 to the body 82. The end cap 84 includes a slot that substantially corresponds to the size and shape of the slot 92 of the body 82. To secure the end cap 84 to the body 82, the body 82 includes a tab (not shown) that engages with a portion of the end cap 84 to facilitate securing the end cap 84 in place. Alternatively, the end cap 84 may be secured to the body 82 by any means that enables the hair setter 80 to function as described herein.

In the exemplary embodiment, the end caps 84 are fabricated from an insulative material or other non-heat-conductive materials, for example, plastic, silicone-based material, resin, or the like, to facilitate reducing an amount of the heat generated by the heat delivery rails 64 from being conducted to the end caps 84. Alternatively, the end caps 84 may be fabricated from any material that enables the end caps to function as described herein. For example, in one, embodiment, the end caps 84 may be fabricated from a metallic material and coated with a heat-resistive material to reduced heat conduction to an outer surface of the end caps 84.

In the exemplary embodiment, as illustrated in FIG. 6, the body 82 of the hair setter 80 includes an outer surface treatment component 98 coupled to the outer surface 94. For example, the outer surface treatment component 98 may include static dissipative coatings, ceramic materials, flocking, resin, felt, velvet, rubber, plastic, and the like, or any combinations thereof, that enable the hair setter 80 to function as described herein.

Figure 7:
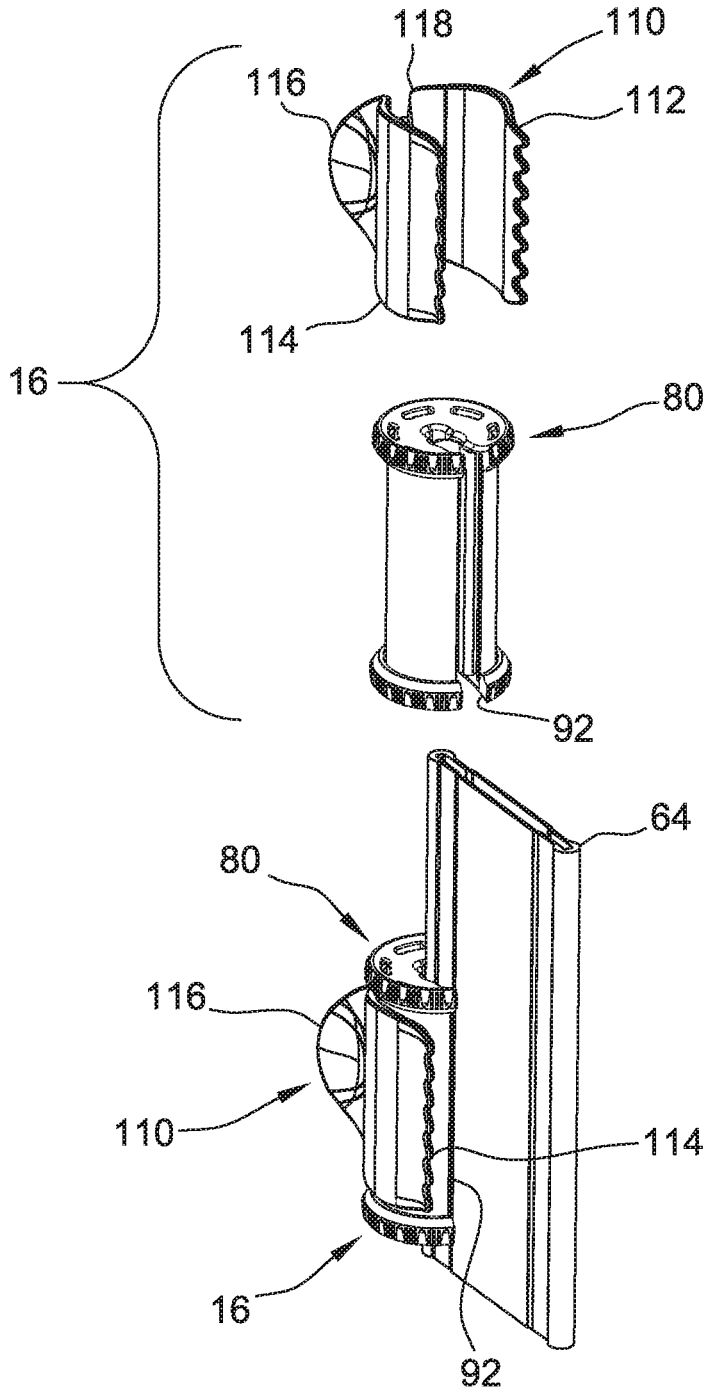
FIG. 7 is an exploded isometric schematic of a pair of large hair setter assemblies coupling with a heat delivery rail of the heater assembly shown in FIG. 5.
Figure 8:
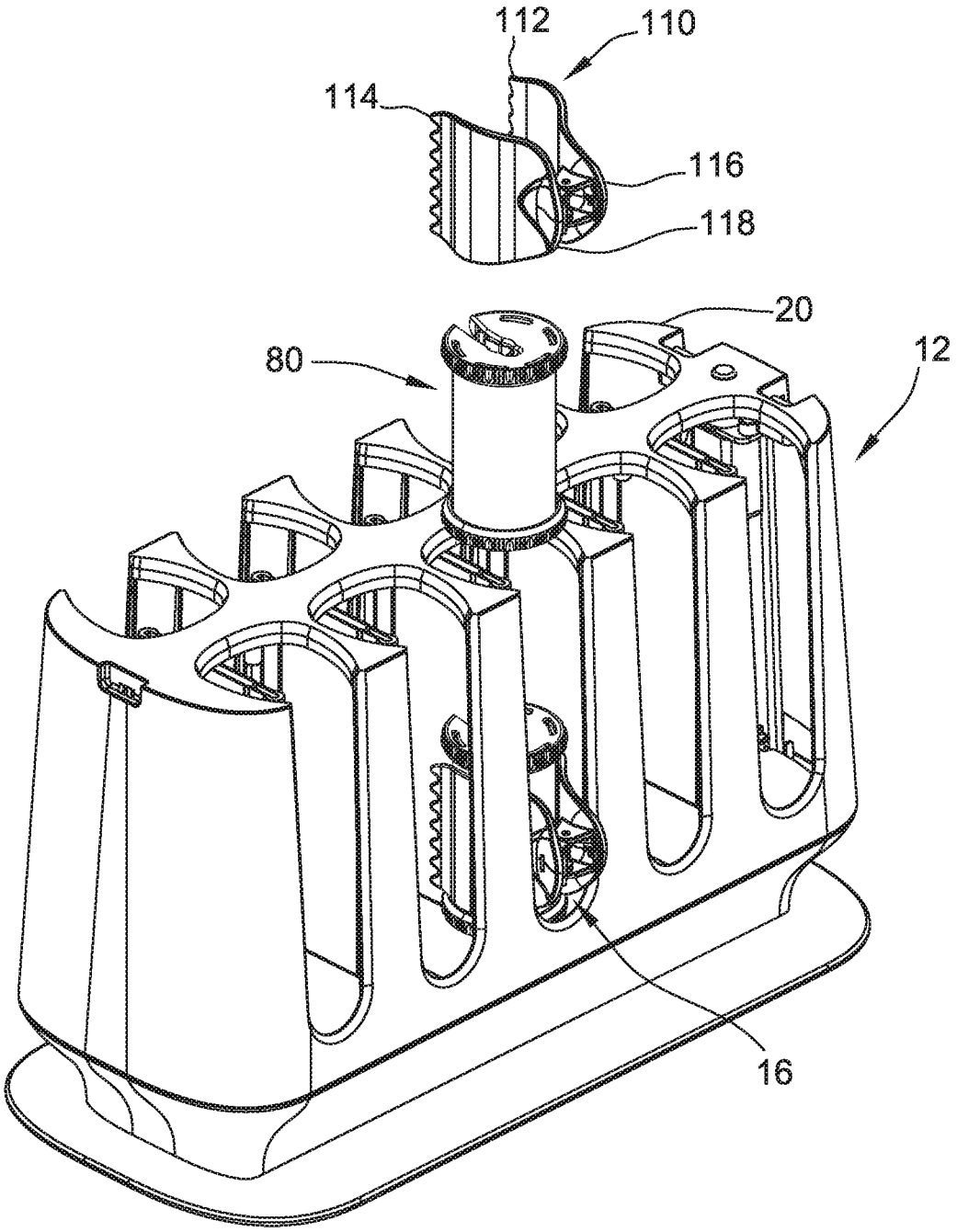
FIG. 8 is an exploded isometric schematic of the pair of large hair setter assemblies being mounted in the housing of the heated hair setter system shown in FIG. 1.

FIG. 7 is an exploded isometric schematic of a pair of large hair setter assemblies 16 coupling with a heat delivery rail 64. FIG. 8 is an exploded isometric schematic of a pair of large hair setter assemblies 16 being mounted in the housing 12. While the large hair setter assembly 16 is described in detail herein, it is noted that the small hair setter assembly 14 operates substantially identically to the large hair setter assembly 16.

In the exemplary embodiment, the hair setter 80 is able to be quickly and easily mounted to the heat delivery rail 64 by axially aligning the hair setter 80 in longitudinally extending alignment with a curved end 120 of an edge of the heat delivery rail 64. By placing each additional hair setter 80, or large hair setter assembly 16, in a stacked arrangement on the heat delivery rail 64 in a substantially similar manner, a desired quantity (e.g., two in the exemplary embodiment) of hair setters 80 or large hair setter assemblies 16 can be placed on the heater assembly 60 to attain the desired heating effect of the hair setters 80.

During operation, with the inner tube 88 and the slot defining web plates 90 in direct engagement with the heat delivery rail 64 of the heater assembly 60, as is described herein, the heat generated by heat delivery rail 64 is quickly transferred directly to the inner tube 88 and the slot defining web plates 90, the other web plates 90, and the outer tube 86. Thus, the exemplary embodiment facilitates increasing the direct contact of hair setter 80 with the heat delivery rail 64, thereby achieving a hair setter 80 that is quickly heated to any desired temperature.

In addition, a further advantage of the illustrated embodiment is the ability to transfer heat to a hair retention clip 110. As shown in FIGS. 7 and 8, the large hair setter assembly 16 includes the hair setter 80 and the retention clip 110 in combination. The retention clip 110 includes a spring-biased butterfly construction that enables arcuately curved grip components 112 and 114 to be pivoted away from each other by applying pressure to finger components 116 and 118 to pivot them towards each other. When the pressure is removed, the retention clip 110 pivots towards its closed configuration due to a bias spring member (not shown) incorporated therein. Thus, the retention clip 110 is easily coupled onto the hair setter 80 in peripherally surrounding engagement, as well as easily removed therefrom.

In the exemplary embodiment, during heating of the hair setter 80, the retention clip 110 is coupled to hair setter 80, as shown in FIGS. 7 and 8. This facilitates heating the retention clip 110 during the heating of the hair setter 80 by the retention clip 110 directly absorbing heat through the outer tube 86 of the hair setter 80. In some embodiments, the grip components 112 and 114 of the retention clip 110 are optionally fabricated from a heat conductive material, for example, a ceramic or a metal, that absorbs and retains heat. To facilitate handling the heated retention clip 110 in such embodiments, the finger components 116 and 118 may be coated with an insulative material or coating. In other suitable embodiments, the grip components 112 and 114 of the retention clip 110 are optionally fabricated from an insulative material, for example, a plastic, that does not absorb or retain heat. In such embodiments, the grip components 112 and 114 may have inner surfaces coated or lined with a heat conductive material, for example, a ceramic or metal. To facilitate handling the heated retention clip 110, the finger components 116 and 118 may be constructed from an insulative material.

The embodiments of the retention clip 110 described herein facilitate reducing the conductive heat transfer to the finger components 116 and 118, enabling a user to operate the retention clip 110 without discomfort. This results in the large hair setter assembly 16, including the hair setter 80 and the retention clip 110, being quickly and efficiently heated by the heater assembly 60. After a heating cycle is completed, the large hair setter assembly 16 is removed, i.e. slide axially off of the heat delivery rail 64 and positioned in a desired location on the hair of the user.

As illustrated in FIG. 7, the retention clip 110 is coupled to the hair setter 80 such that the slot 92 of the hair setter 80 is generally aligned with an opening created between the grip components 112 and 114 of the retention clip 110. This enables the hair setter 80 to be axially coupled or mounted to the heat delivery rail 64. The retention clip 110, however, is configured to be mounted to the outer surface 94 of the body 82 of the setter 80 in any rotational position to facilitate ease of use of the retention clip 110 and hair setter 80 on the hair of the user. Thus, the user may mount the retention clip 110 to the hair setter 80 such that one of the grip components 112 or 114 extends across or partially across the slot 92. This may inhibit the hair setter 80 from being coupled to or mounted on the heat delivery rail 64, or may cause a portion of one of the grip components 112 and 114 of the retention clip 110 to come into contact with the heat delivery rail 64. The direct contact between the heat delivery rail 64 and one of the grip components 112 and 114 of the retention clip 110 may cause heat damage to the retention clip 110. The access openings 18 in the housing 12, however, facilitate proper alignment of the retention clip 110 to the hair setter 80 when coupled or mounted to the heat delivery rail 64.

Figure 9:
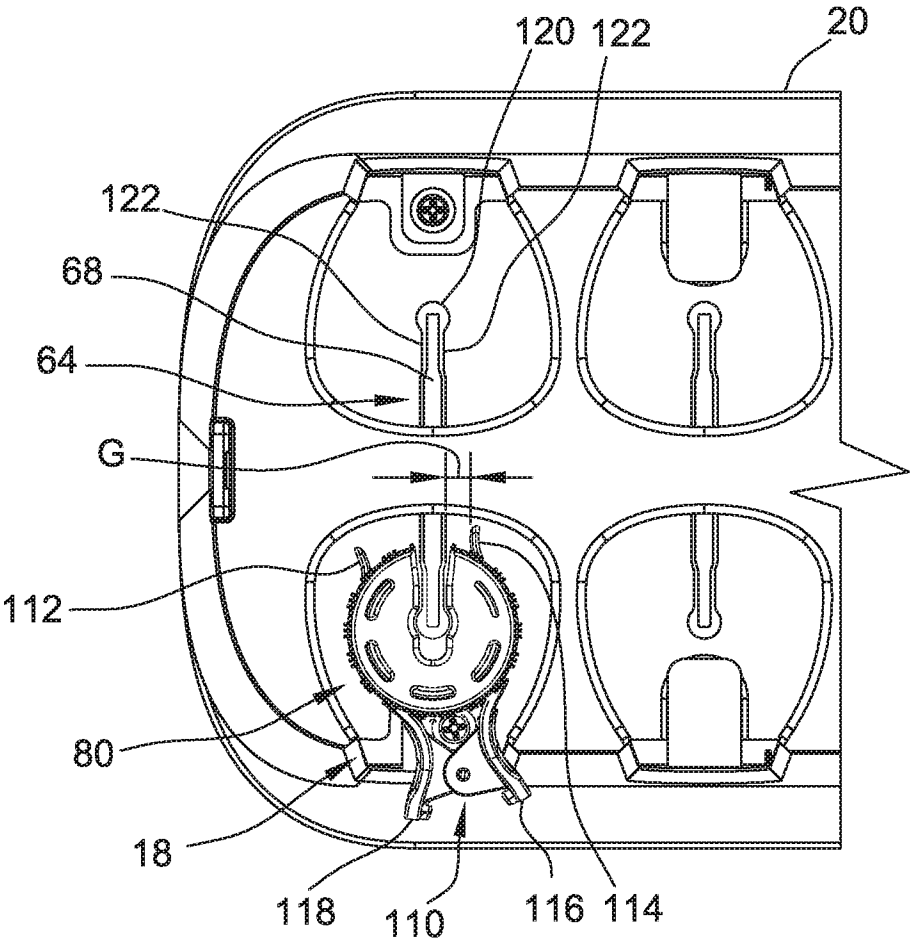
FIG. 9 is a top view of the base of the housing illustrating one of the small hair setter assemblies mounted to a heat delivery rail of the heater assembly shown in FIG. 5.

FIG. 9 is a top view of the base 20 of the housing 12 illustrating one of the small hair setter assemblies 14 mounted to a heat delivery rail 64. In the illustrated configuration, the retention clip 110 is mounted to the hair setter 80 and rotated such that the finger component 116 of the retention clip 110 is in contact with an edge of the access opening 18. While the retention clip 110 is free to be mounted to the hair setter 80 in any rotation position, to mount the hair setter 80 to the heat delivery rail 64, the finger components 116 and 118 must be positioned to fit between the edges of the access opening 18. When the retention clip 110 is rotated to its limit, i.e., contacting the edges of the access opening 18, the grip components 112 and 114 of the retention clip 110 do not contact the heat delivery rail 64. For example, as illustrated, the grip component 114 of the retention clip 110 is spaced a gap "G" from the heat delivery rail 64 with the finger component 116 of the retention clip 110 contacting an edge of the access opening 18. Thus, the access opening 18 inhibits the hair setter assemblies 14 and 16 from being mounted to the heat delivery rails 64 in a manner that enables the retention clip 110 to come into direct contact with the heat delivery rails 64. In addition, the vertical slot 52 of the access opening 18 is configured to inhibit the user from contacting the heat delivery rails 64 contained within the housing 12.

In addition, as illustrated in FIG. 9 and as described herein, the heat delivery rails 64 include parallel, opposing grooves 122 intersecting curved ends 120, i.e. a curved edge if the heat delivery rails 64. The web plates 90 that form the slot 92 of the hair setter 80 are configured to directly contact the grooves 122 in a sliding configuration. The inner tube 88 of the body 82 of the hair setter 80 is configured to directly contact the curved end 120 of the heat delivery rails 64. In the exemplary embodiment, the curved ends 120 are substantially semicircular in cross-section. Thus, as can been seen, the curved end 120 and the grooves 122 cooperate with the slot 92 on the inner tube 88 of the hair setter 80 to facilitate maintaining or holding the hair setter 80 to the heat delivery rail 64, only allowing axial movement. Thus, the hair setter 80 must be axially slid along a length of the heat delivery rails 64 and removed from the housing 12 through the curved shaped insert opening 50.

During operation, the user applies pressure to the finger components 116 and 118 to pivot them towards each other, which causes the curved grip components 112 and 114 to be pivoted away from each other. The retention clip 110 is positioned peripherally about the hair setter 80 and the pressure is removed from the finger components 116 and 118, which causes the curved grip components 112 and 114 to pivot towards each other. This enables the retention clip 110 to engage the outer surface 94 of the hair setter 80. The user couples the retention clip 110 the hair setter 80 such that the slot 92 of the hair setter 80 is generally aligned with the opening created between the grip components 112 and 114 of the retention clip 110. The combination of the retention clip 110 coupled to the hair setter 80 is described herein as the hair setter assembly 14 and/or 16.

The user slides the hair setter assembly 14 and/or 16 on the heater assembly 60 contained in the housing 12. More specifically, the user grasps the finger components 116 and 118 and inserts the hair setter assembly 14 and/or 16 into the insert opening 50 of the access opening 18, taking care to axially align the hair setter slot 92 in longitudinally extending alignment with the curved end 120 and the grooves 122 located at an edge of the heat delivery rail 64. The user slides the hair setter assembly 14 and/or 16 along the heat delivery rail 64 such that the finger components 116 and 118 are positioned in the vertical slot 52 of the insert opening. The hair setter assembly 14 and/or 16 slides along the heat delivery rail 64 until the end cap 84 comes into contact with the support plate 66 of the heater assembly 60. The user may then slide a second hair setter assembly 14 and/or 16 on the same heat delivery rail 64 until its end cap 84 contacts the first hair setter assembly 14 and/or 16, thereby stacking vertically two hair setter assembly 14 and/or 16 in a single access opening 18. As described herein, the vertical slot 52 cooperates with the retention clip finger components 116 and 118 to prevent the retention clip curved grip components 112 and 114 from making contact with the heat delivery rail 64.

The apparatus, system, and methods described in detail herein enable a user to achieve a rapidly heated hair setter that is capable of being easily employed for rapidly absorbing heat from the heat delivery rail 64. Once hair setter 80 has been heated to a desired level, the hair setter 80 is removal from the heat delivery rail 64 and used in the conventional manner. If the embodiment employing the hair retention clips 110 is employed, the heated hair clip 110 is also used in a generally conventional manner, further improving and enhancing the heat being delivered to the rolled hair fibers on the hair setter 80.

Exemplary embodiments of an apparatus, system, and methods for a heated hair setter system are described above in detail. The apparatus, system, and methods described herein are not limited to the specific embodiments described, but rather, components of apparatus, systems, and/or steps of the methods may be utilized independently and separately from other components and/or steps described herein. For example, the methods may also be used in combination with other heated hair styling apparatuses, systems, and methods, and are not limited to practice with only the apparatuses, systems, and methods described herein. Rather, the exemplary embodiments can be implemented and utilized in connection with many heated hair styling applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As various changes could be made in the above embodiments without departing from the scope of the disclosure, it is intended that all matter contained in the above description and shown in the accompanying drawings shall be interpreted as illustrative and not in a limiting sense.

What is claimed is:

1. A hair setter apparatus comprising:

a housing comprising a base and a lid, the base comprising a top wall and a plurality of side walls together with the base and top wall defining an interior space of the housing, the base further comprising a plurality of access openings open to the interior space of the housing, each access opening comprising an insert opening at the top wall and a vertical slot in at least one of the side walls and intersecting the insert opening at the top wall of the housing;

a heater assembly enclosed within the housing, the heater assembly comprising a first heat delivery rail and a second heat delivery rail mounted in the housing in spaced parallel relationship to each other, each heat delivery rail having a longitudinal edge extending parallel and generally adjacent to a respective one of the vertical slots and generally below a corresponding insert opening; and a plurality of hair setters, each of the hair setters comprising a central body having opposing web plates spaced from each other to define a mounting slot extending longitudinally of the hair setter, the opposing web plates being configured to slidably couple the hair setter to one of the heat delivery rails along the longitudinal edge of said one of the heat delivery rails, the hair setter being sized relative to the insert opening for insertion of the hair setter through the insert opening and onto the respective one of the heat delivery rails within the interior space of the housing.

2. The hair setter apparatus in accordance with claim 1 further comprising a plurality of retention clips each configured to be removably coupled to a respective one of the hair setters in peripherally surrounding engagement thereof.

3. The hair setter apparatus in accordance with claim 2, wherein each retention clip comprises a pair of opposing finger components and a pair of curved grip components, the pair of curved grip components engaging the hair setter when coupled to the hair setter, the pair of finger components extending through the vertical slot of said one of the side walls when the hair setter is coupled to the heat delivery rail.

4. The hair setter apparatus in accordance with claim 3, wherein the vertical slot has a width configured to inhibit the hair setter against removal from the housing through the vertical slot.

5. The hair setter apparatus in accordance with claim 1, wherein the insert opening and the vertical slot comprise tapered edges to facilitate insertion of the hair setters into the interior space of the housing.

6. The hair setter apparatus in accordance with claim 1, wherein at least two hair setters can be stacked one on top of the other along the longitudinal edge of the heat delivery rail.

7. The hair setter apparatus in accordance with claim 1, wherein the mounting slot extends longitudinally along an entire length of the hair setter.

8. The hair setter apparatus in accordance with claim 1, wherein the central body further comprises an inner tube and a cylindrically-shaped outer tube concentric with the inner tube, wherein the web plates couple the inner tube to the outer tube.

9. The hair setter apparatus in accordance with claim 8, wherein the central body comprises an outer surface treatment component coupled to an outer surface of the outer tube.

10. The hair setter apparatus in accordance with claim 9, wherein the outer surface treatment component is selected from the group consisting of a static dissipative coating, ceramic material, flocking, resin, felt, velvet, rubber, plastic, and combinations thereof.

11. The hair setter apparatus in accordance with claim 8, wherein the mounting slot defined by the opposed web plates has a width, the inner tube having an inner diameter greater than the width of the mounting slot.

12. The hair setter apparatus in accordance with claim 1, wherein the central body is constructed from a metallic material.

13. The hair setter apparatus in accordance with claim 1, wherein the central body is constructed from an aluminum extrusion.

14. The hair setter apparatus in accordance with claim 1, wherein the first heat delivery rail includes a groove extending longitudinally along at least part of the heat delivery rail.

15. The hair setter apparatus in accordance with claim 14, wherein the heat delivery rail further comprises a semicircular end portion intersecting the groove.

16. The hair setter apparatus in accordance with claim 14, wherein the first heat delivery rail is symmetrical about a longitudinal axis thereof and has pair of opposite edges, the groove comprising a first groove extending longitudinally adjacent one of said edges, the first heat delivery rail further having a second groove extending longitudinally adjacent the opposite one of said edges.

17. A method of operating a hair setter apparatus, the method comprising coupling a retention clip to a hair setter, the hair setter comprising a central body having opposing web plates spaced from each other to define a mounting slot extending longitudinally of the hair setter;

inserting the hair setter through an access opening of a housing, the housing comprising a base and a lid, the base comprising a top wall and a plurality of side walls together with the base and top wall defining an interior space of the housing, the base further comprising a plurality of the access openings open to the interior space of the housing, each access opening comprising an insert opening at the top wall and a vertical slot in at least one of the side walls and intersecting the insert opening at the top wall of the housing, wherein the hair setter is sized relative to the insert opening for insertion of the hair setter through the insert opening and onto a heat delivery rail mounted within the interior space of the housing; and slidably coupling the hair setter onto the heat delivery rail, the heat delivery rail having a longitudinal edge extending parallel and generally adjacent to the vertical slot and generally below the insert opening.

18. The method in accordance with claim 17, wherein coupling the retention clip to the hair setter comprises coupling the retention clip to the hair setter such that opposed grip components of the retention clip do not extend over slot of the hair setter.

19. The method in accordance with claim 17, wherein the hair setter is a first hair setter and the retention clip is a first retention clip, the method further comprising:

coupling a second retention clip to a second hair setter, the second hair setter including a longitudinally extending slot;

aligning the longitudinally slot of the second hair setter with the longitudinal edge of the heat delivery rail; and sliding the second hair setter onto the heat delivery rail in stacked relationship with the first hair setter.

20. The method in accordance with claim 17 further comprising aligning the longitudinally extending slot with the longitudinal edge of the heat delivery rail, the heat delivery rail including a groove extending longitudinally adjacent the longitudinal edge of the heat delivery rail.

* * * * *